US005988365A

United States Patent [19]

McAdams

[11] Patent Number: 5,988,365

[45] Date of Patent: Nov. 23, 1999

[54] COIN DISPLAY CASE

[76] Inventor: Natalie D McAdams, 95-461 Kaulia Pl., Mililani, Hi. 96789

[21] Appl. No.: 09/076,540

[22] Filed: May 12, 1998

[51] Int. Cl.[6] ..... A45C 11/00

[52] U.S. Cl. ..... 206/0.83; 206/0.84; 206/782

[58] Field of Search ..... 206/0.8, 0.81, 206/0.82, 0.83, 0.84, 775, 776, 777, 782

[56] References Cited

U.S. PATENT DOCUMENTS 4,402,399 9/1983 Friess ..... 206/84 X 4,592,465 6/1986 Stein ..... 206/8

*Primary Examiner*—Jacob K. Ackun

*Attorney, Agent, or Firm*—Michael I Kroll

[57] ABSTRACT

A coin display case (10) comprising a frame (12). A front transparent plate (14) is carried in the frame (12). A rear transparent plate (16) is carried in the frame (12). A middle retainer plate (18) having a plurality of circular openings (20) to hold coins (22) therein, is placed flush between the front transparent plate (14) and the rear transparent plate (16). A stand (24) is also provided. A facility (26) is for retaining the frame (12) with the front transparent plate (14), the rear transparent plate (16) and the middle retainer plate (18) to the stand (24) in an upright position. The coins (22) inserted in the circular openings (20) in the middle retainer plate (18) can be viewed in their entirety therefrom, since both sides of the coins (22) are in full view.

5 Claims, 5 Drawing Sheets

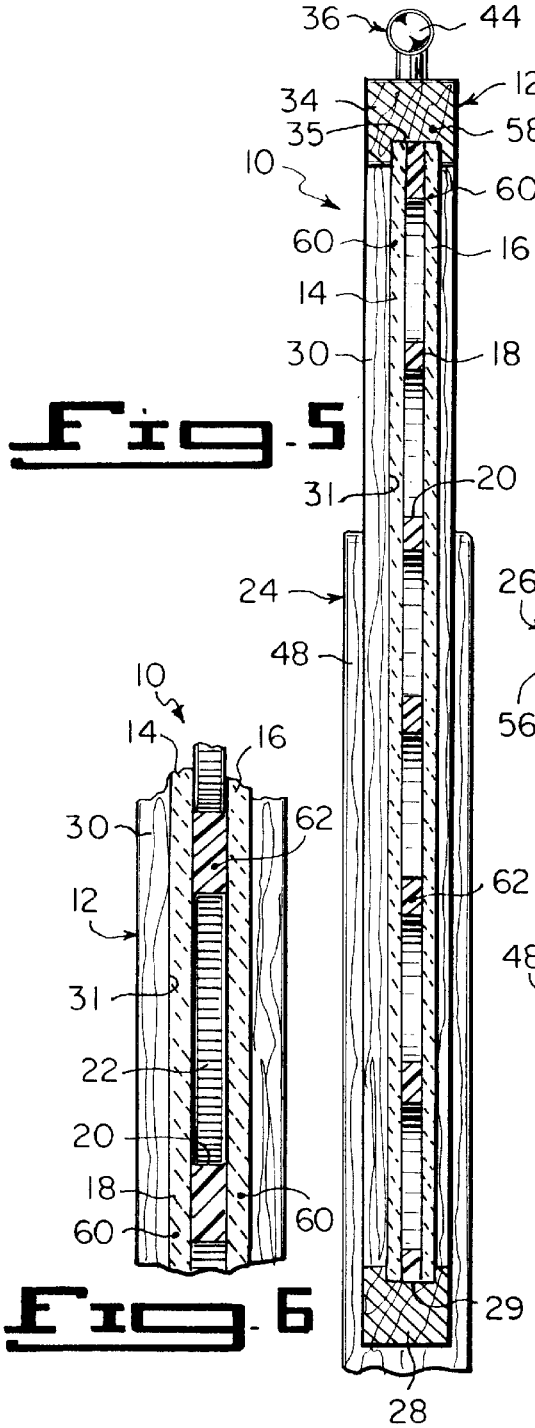
Fig. 5
Fig. 6
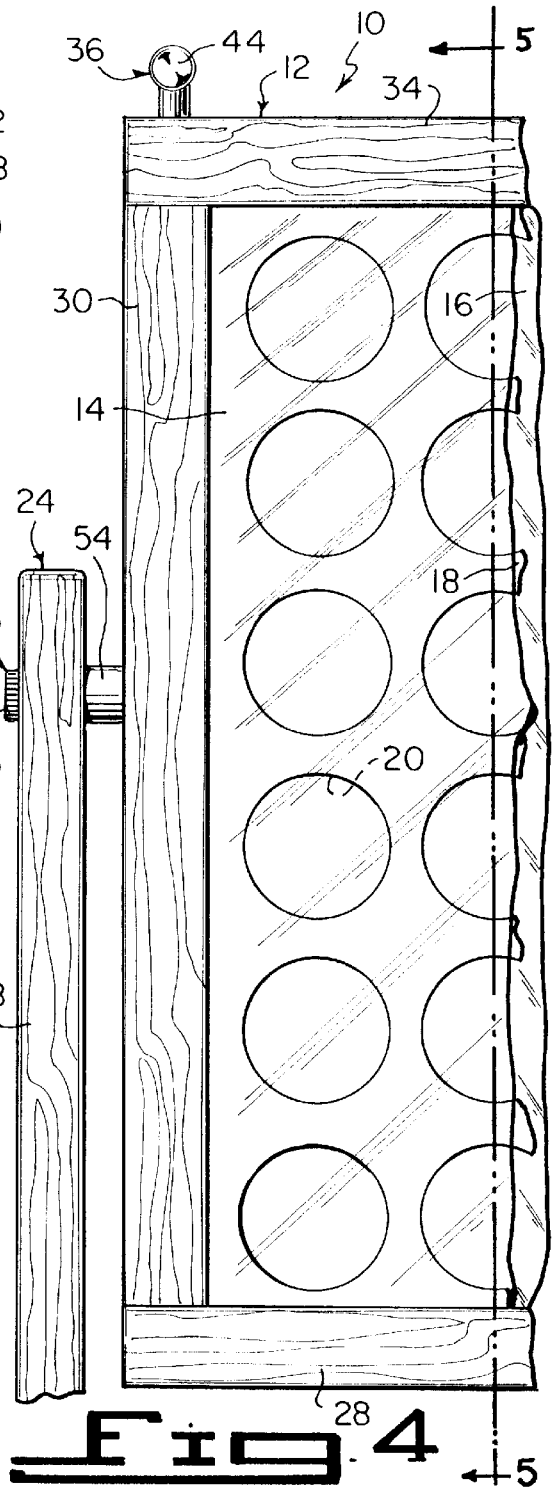
Fig. 4

COIN DISPLAY CASE

BACKGROUND OF THE INVENTION

Field of the Invention

The instant invention relates generally to coin holders and more specifically it relates to a coin display case. The coin display case consists of a middle retainer plate having a plurality of circular openings to hold coins therein, placed flush between front and rear transparent plates in a frame on a stand, so that the coins can be viewed in their entirety therefrom, since both sides of the coins are in full view. The middle retainer plate can be made with different sized circular openings to hold different sized coins therein to be viewed therefrom.

Description of the Prior Art

Numerous coin holders have been provided in prior art that are adapted to retain coins therein, so that the coins can be viewed therefrom. While these units may be suitable for the particular purpose to which they address, they would not be as suitable for the purposes of the present invention as heretofore described.

SUMMARY OF THE INVENTION

A primary object of the present invention is to provide a coin display case that will overcome the shortcomings of the prior art devices.

Another object is to provide a coin display case that consists of a middle retainer plate having a plurality of circular openings to hold coins therein, placed flush between front and rear transparent plates in a frame on a stand, so that the coins can be viewed in their entirety therefrom, since both sides of the coins are in full view.

An additional object is to provide a coin display case in which the middle retainer plate can be made with different sized circular openings to hold different sized coins therein to be viewed therefrom.

A further object is to provide a coin display case that is simple and easy to use.

A still further object is to provide a coin display case that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 2 is a partially exploded perspective view of the present invention, with parts broken away and in section.

FIG. 4 is an elevational view taken in the direction of arrow 4 in FIG. 1, with parts broken away.

FIG. 5 is a cross sectional view taken along line 5—5 in FIG. 4.

FIG. 6 is a cross sectional view taken along line 6—6 in FIG. 3.

Similar reference characters denote corresponding features consistently throughout the attached drawings.

DESCRIPTION OF THE PREFERRED EMBODIMENTS

Figure 1:
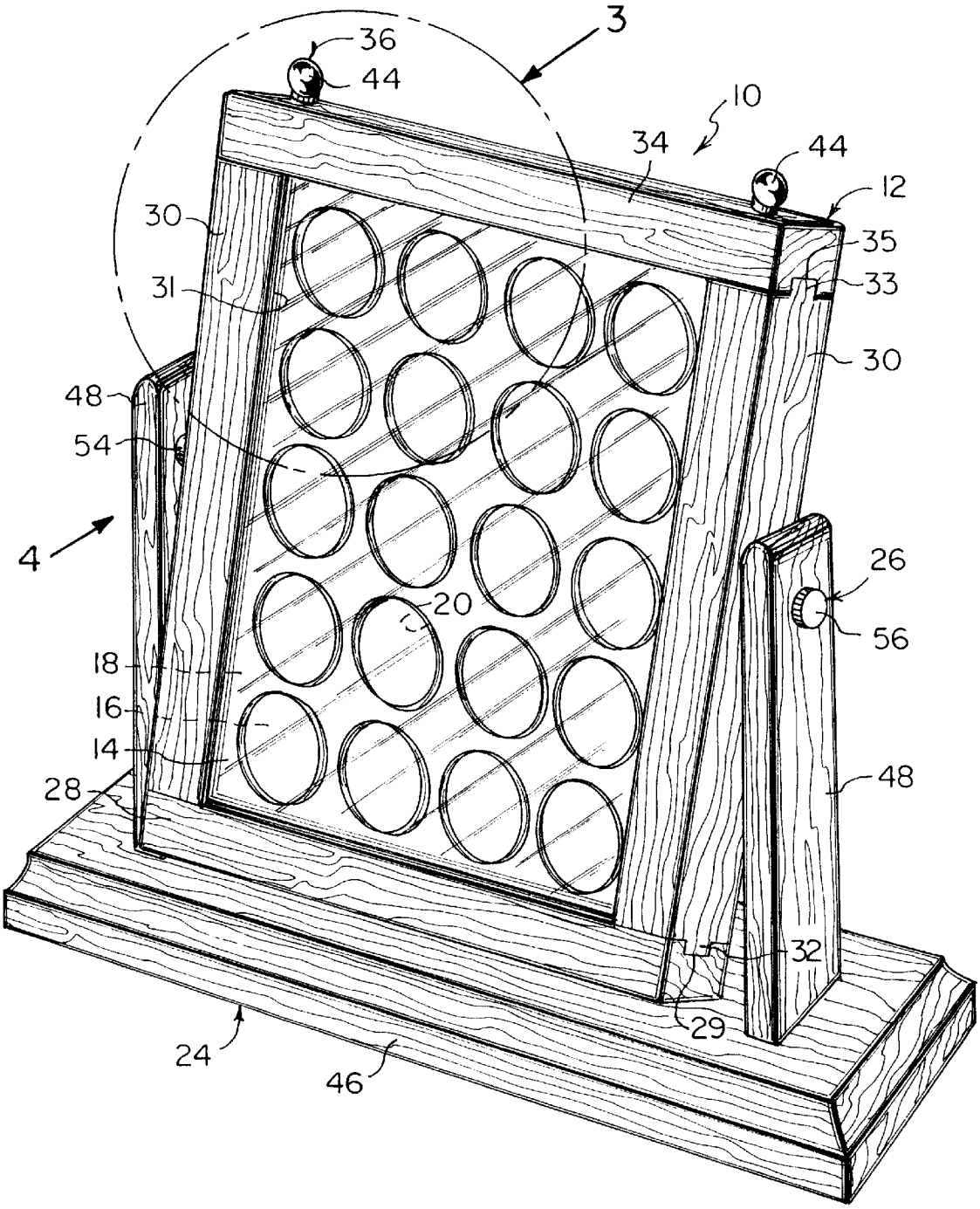
FIG. 1 is a perspective view of a first embodiment of the present invention.
Figure 3:
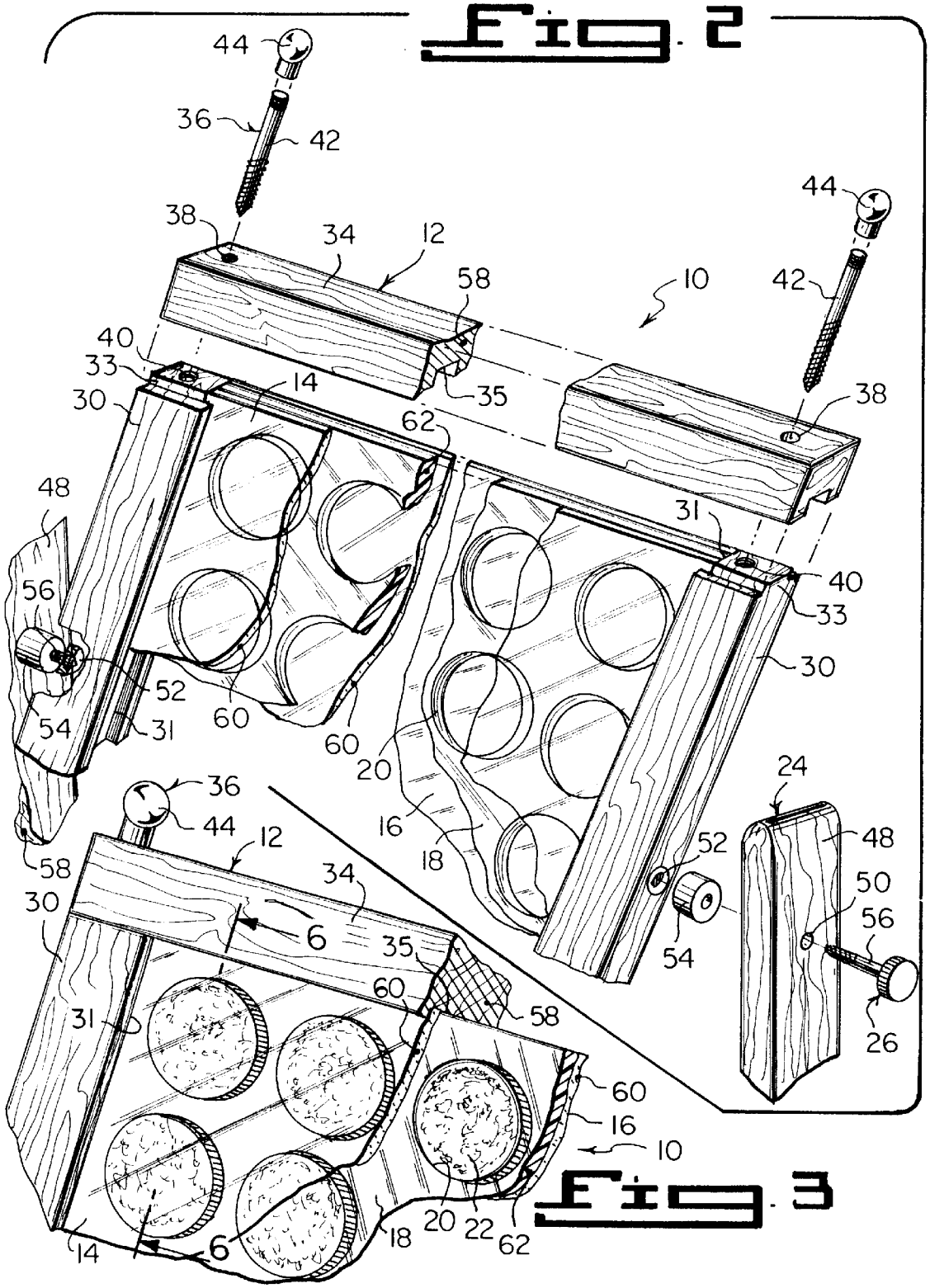
FIG. 3 is an enlarged perspective view of an area in FIG. 2, with coins installed within the circular openings in the middle retainer plate.

Turning now descriptively to the drawings, in which similar reference characters denote similar elements throughout the several views, FIGS. 1 through 6 illustrate a first embodiment of the present invention being a coin display case 10. With regard to the reference numerals used, the following numbering is used throughout the various drawing figures.

10 coin display case
12 frame of 10
14 front transparent plate of 10
16 rear transparent plate of 10
18 middle retainer plate of 10
20 circular opening in 18
22 coin in 20
24 stand of 10
26 retaining facility of 10
28 bottom rail of 12
29 longitudinal inner groove in 28
30 side stile of 12
31 longitudinal inner groove in 30
32 bottom end tongue on 30
33 top end tongue on 30
34 top rail of 12
35 longitudinal inner groove in 34
36 maintaining structure of 12
38 hole in 34
40 internally threaded bore in 33
42 hanger screw of 36
44 decorative ball cap of 36
46 base of 24
48 arm of 24
50 aperture in 48
52 internally threaded sleeve of 26
54 spacer of 26

56 bolt of 26
58 wood for 12 and 24
60 sheet of glass for 14 and 16
62 acrylic insert sheet for 18
64 top rail of 12
66 base of 24
68 arm of 24
70 longitudinal inner groove in 68

The coin display case 10 comprises a frame 12, with a front transparent plate 14 is carried in the frame 12. A rear transparent plate 16 is carried in the frame 12, while a middle retainer plate 18 having a plurality of circular openings 20 to hold coins 22 therein, is placed flush between the front transparent plate 14 and the rear transparent plate 16. A stand 24 is also provided. A facility 26 is for retaining the frame 12 with the front transparent plate 14, the rear transparent plate 16 and the middle retainer plate 18 to the stand 24 in an upright position. The coins 22 inserted in the circular openings 20 in the middle retainer plate 18 can be viewed in their entirely therefrom, since both sides of the coins 22 are in full view.

The frame 12 in FIGS. 1 through 8, includes a bottom rail 28 having a longitudinal inner groove 29. A pair of side stiles 30 are provided. Each side stile 30 has a longitudinal inner groove 31, a bottom end tongue 32 and a top end tongue 33. The bottom end tongues 32 of the side stiles 30 can be affixed within the longitudinal inner groove 29 of the bottom rail 28 at opposite ends of the bottom rail to extend upwardly therefrom. A top rail 34 having a longitudinal inner groove 35 is also provided. A structure 36 is for maintaining the longitudinal inner groove 35 of the top rail 34 in a removable manner to the top end tongues 33 of the side stiles 30.

The maintaining structure 36, as best seen in FIG. 2, consists of the top rail 34 having a hole 38 extending transversely through each end. Each of the side stiles 30 has an internally threaded bore 40 in the top end tongue 33. A pair of hanger screws 42 are provided. Each hanger screw 42 fits through one hole 38 in the top rail 34 and threads into one internally threaded bore 40 in one top end tongue 33 of the side stile 30.

The maintaining structure 36 further includes a pair of decorative ball caps 44, which thread onto each of the hanger screws 42. The stand 24, as best seen in FIG. 1, contains a base 46 and a pair of arms 48 that are affixed at lower ends to and extend upwardly from opposite ends of the base 46 between the side stiles 30 of the frame 12.

The retaining facility 26, as best seen in FIG. 2, includes each of the arms 48 having an aperture 50 extending transversely therethrough adjacent an upper end. A pair of internally threaded sleeves 52 are provided. Each sleeve 52 is aligned and mounted into an outer surface of each side stile 30 of the frame 12. A pair of spacers 54 and a pair of bolts 56 are also provided. Each bolt 56 fits through one aperture 50 in the arm 48, one spacer 54 and threads into one sleeve 52 in one side stile 30 of the frame 12.

The frame 12 and the stand 24 are each fabricated out of wood 58. The front transparent plate 14 and the rear transparent plate 16 are each fabricated out of a sheet of glass 60. The middle retainer plate 18 is fabricated out of an acrylic insert sheet 62.

Figure 8:
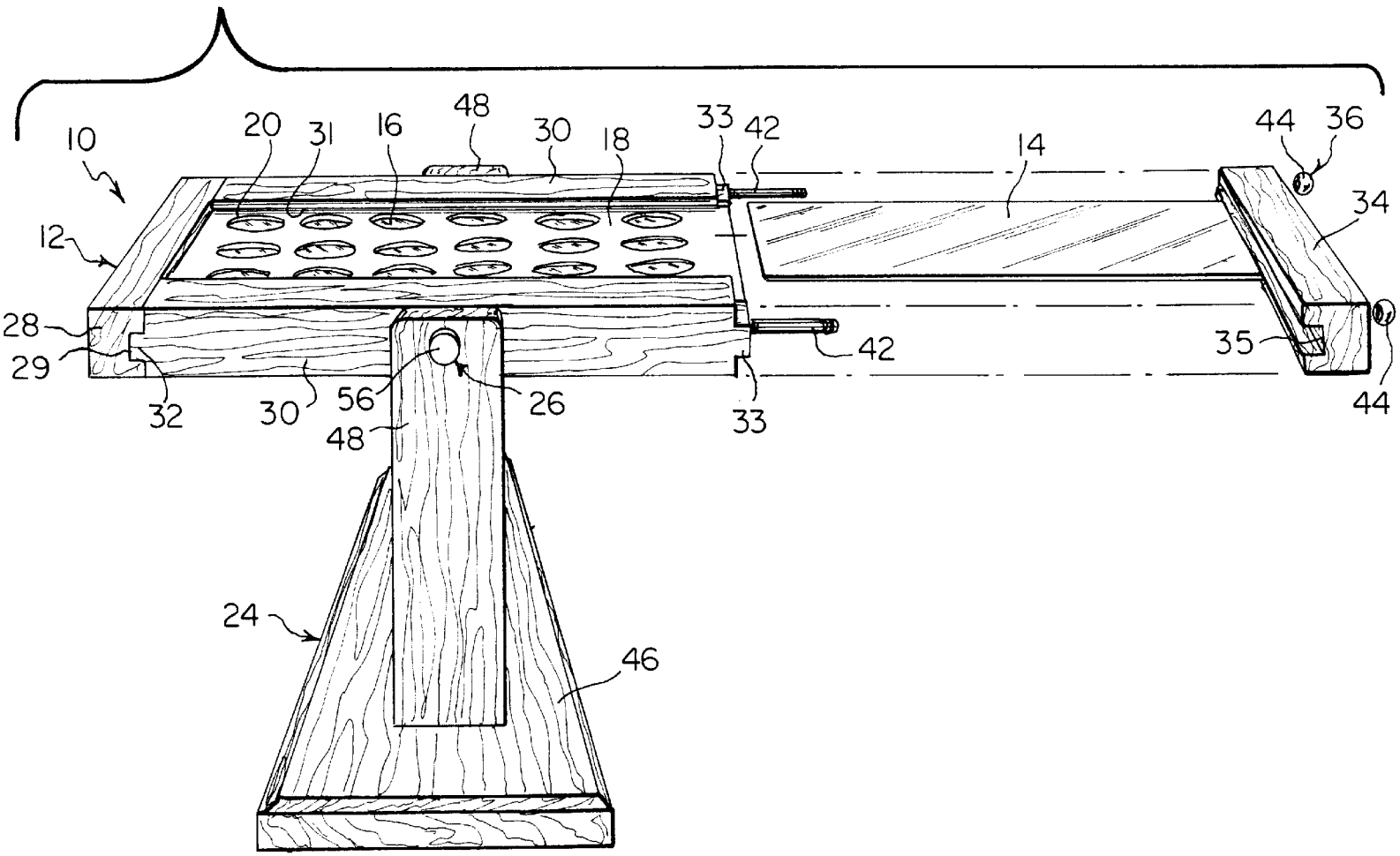
FIG. 8 is a partially exploded perspective view of the first embodiment of the present invention, showing the frame in a horizontal position with respect to the stand, to allow coins to be inserted within the circular openings in the middle retainer plate.

The frame 12 can be removed from the stand 24 and mounted on a wall. The frame 12 can rotate in the stand 24, to allow the coins 22 in the frame 12 to be viewed at different angles. As shown in FIG. 8, the frame 12 can be rotated horizontal on the stand 24. The front transparent plate 14 is then removed to allow the coins 22 to be inserted in the circular openings 20 in the middle retainer plate 18, so that they will not fall out. The front transparent plate 14 is placed back into the frame 12 and rotated to an upright position.

Figure 7:
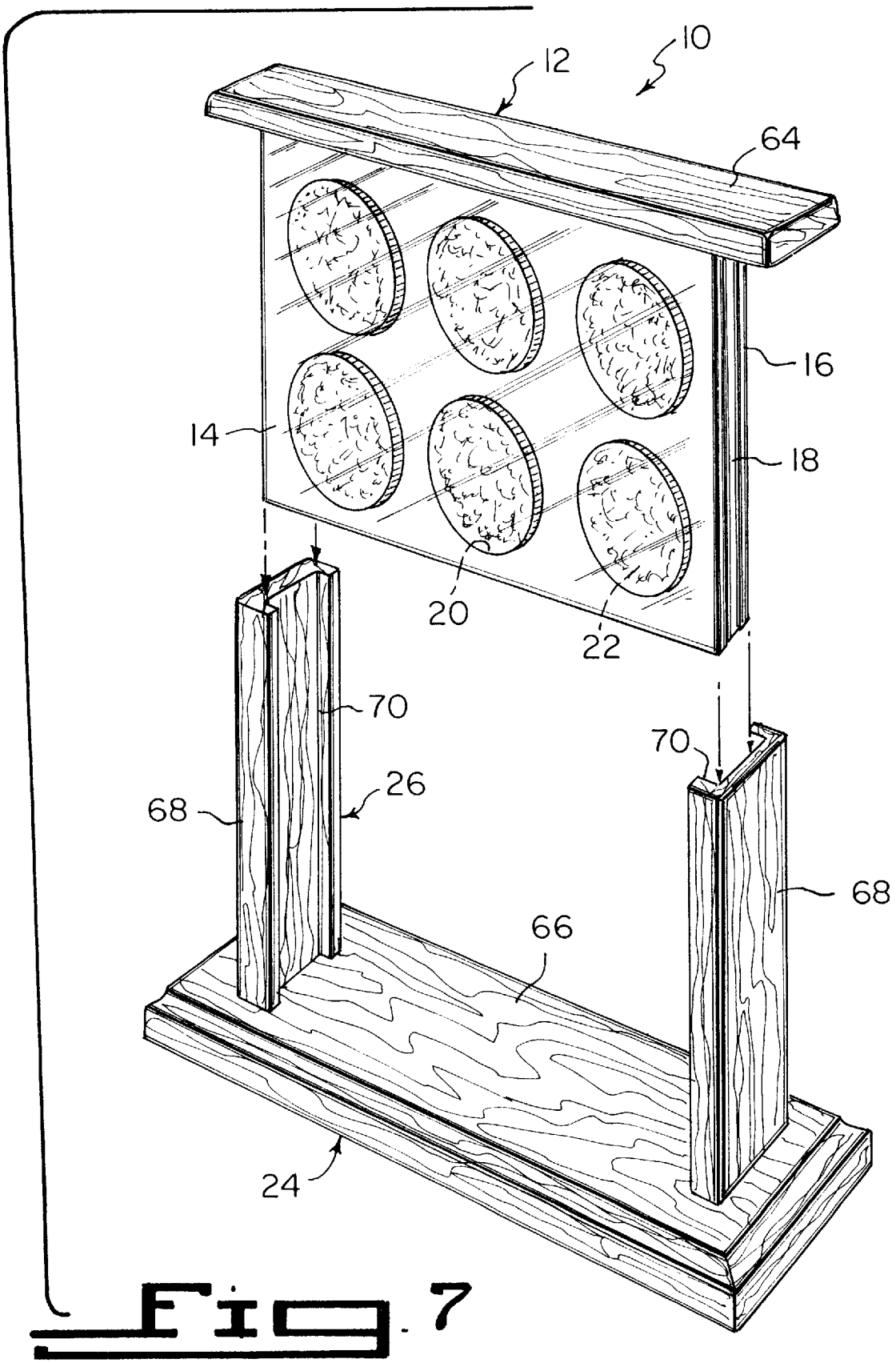
FIG. 7 is a partially exploded perspective view of a second embodiment of the present invention.

A modified coin display case 10, is shown in FIG. 7, wherein the frame 12 includes a top rail 64 to engage in a spaced apart relationship, a top edge of the front transparent plate 14 and the rear transparent plate 16, so that the middle retainer plate 18 can fit therebetween. The stand 24 consists of a base 66 and a pair of arms 68 that are affixed at lower ends to and extend upwardly from opposite ends of the base 66. The retaining facility 26 comprises each of the arms 68 having a longitudinal inner groove 70, to engage a side edge of the front transparent plate 14, the rear transparent plate 16 and the middle retainer plate 18.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A coin display case comprising:

a) a frame comprising a bottom rail having a longitudinal inner groove, a pair of parallel side stiles wherein each said side stile has a longitudinal inner groove, and tongue and groove means for affixing a first end of each of said side stiles to opposite ends of said bottom rail, with the inner grooves aligned;

b) front and rear transparent plates 1 carried in said frame slidable in said inner grooves;

c) a middle retainer plate having a plurality of circular openings to hold coins therein, placed flush between said front transparent plate and said rear transparent plate;

d) a readily removable top rail having a longitudinal inner groove for receiving said transparent and retainer plates and having means for attaching said top rail at opposite ends to the second ends of said stiles;

e) means for mounting said frame on a stand to permit said frame to be rotated so as to permit said coins to be visible on both sides at any angle and in a horizontal plane to permit said top rail to be removed permitting said middle retainer plate and a transparent plate under said middle retainer plate to be slid out of said frame for removing, replacing, or inspecting individual coins;

f) said stand comprising a base, a pair of upwardly extending spaced arms, and means pivotally mounting said frame on said spaced arms; and g) said attaching means comprising a pair of screw members threaded into the ends of said stiles through said top rail, said screw members having ball caps for finger turning of said screw members for removing and replacing said top rail and the easy sliding in and out of said plates in and out of said frame.

2. A coin display case as recited claim 1, wherein said pivotally mounting means includes:

a) each of said arms having an aperture extending transversely therethrough adjacent an upper end;

b) a pair of internally threaded sleeves, in which each said sleeve is aligned and mounted into an outer surface of each said side stile of said frame;

c) a pair of spacers; and d) a pair of bolts, in which each said bolt fits through one said aperture in said arm, one said spacer and threads into one said sleeve in one said side stile of said frame.

3. A coin display case as recited in claim 1, wherein said frame and said stand are each fabricated out of wood.

4. A coin display case as recited in claim 1, wherein said front transparent plate and said rear transparent plate are each fabricated out of a sheet of glass.

5. A coin display case as recited in claim 1, wherein said middle retainer plate is fabricated out of an acrylic insert sheet.

* * * * *